United States Patent [19]

Beckerman et al.

[11] Patent Number: 5,060,852

[45] Date of Patent: Oct. 29, 1991

[54] WINDOWED BOXES, BLANKS FOR MAKING THE SAME AND ASSOCIATED METHOD

[75] Inventors: Alan Beckerman; Beth A. Brady, both of Pittsburgh, Pa.

[73] Assignee: Package Products, Inc., Pittsburgh, Pa.

[21] Appl. No.: 491,669

[22] Filed: Mar. 8, 1990

[51] Int. Cl.[5] ..... B65D 5/42

[52] U.S. Cl. ..... 229/162; 206/45.31; 493/56; 493/84; 493/905

[58] Field of Search ..... 229/162; 206/45.31, 206/45.34; 493/56, 84, 905

[56] References Cited

U.S. PATENT DOCUMENTS

| | | | |
|---|---|---|---|
| D. 86,129 | 2/1933 | Levkoff | 206/45.31 |
| 1,831,920 | 11/1931 | Marsh | 229/162 |
| 2,013,227 | 9/1935 | Wilson | 206/45.31 |
| 2,113,288 | 4/1938 | Berger | 206/45.31 |
| 2,170,906 | 8/1939 | Mertz | 206/45.31 |
| 2,575,452 | 11/1951 | Klein | 206/45.31 |
| 2,921,673 | 1/1960 | Ryan | 206/45.31 |
| 2,944,727 | 7/1960 | Moore | 229/162 |
| 3,690,523 | 9/1972 | Link | 229/162 |
| 4,117,924 | 10/1978 | Growney | 206/45.31 |
| 4,424,897 | 1/1984 | Ondris et al. | 206/45.31 |

*Primary Examiner*—Gary E. Elkins

*Attorney, Agent, or Firm*—Arnold B Silverman

[57] ABSTRACT

A box having a cover with a plurality of windows and at least a majority of the windows being elongated and oriented in generally spaced relationship with respect to each other. Each window is defined at least in part by a pair of spaced window defining sides. A first or leading series of such window defining sides is disposed in non-parallel relationship with each of a second or trailing series of window defining sides. This serves to facilitate manufacture of boxes from blanks that are readily movable over each other without undesirable edge-to-edge continuous contact which inhibits relative sliding movement during manufacture. The non-parallel window defining sides may be inwardly concave or have each window defined in part by a pair of straight window defining sides which diverge. An associated method for establishing container blanks of this type is disclosed.

37 Claims, 3 Drawing Sheets

WINDOWED BOXES, BLANKS FOR MAKING THE SAME AND ASSOCIATED METHOD

BACKGROUND OF THE INVENTION

1. Field of the Invention

The present invention relates to boxes such as food boxes which contain windows, blanks for making the same, and an associated method and, more specifically, it relates to windows which are defined in such a manner that the blanks may readily slide over each other during handling and manufacture so as to resist undesired engagement of a pair of blanks which could interfere with the manufacturing process.

2. Description of the Prior Art

It has been known to provide various types of boxes such as boxes employed for bakery products or other food products with windows. In general, these windows are openings in the box which may be paperboard, for example, with transparent plastic or paper material secured over these openings. This permits the contents of the box to be seen without opening the box, while resisting undesired contamination of the contents.

It has been known to provide windowed boxes with a separate cover which contains a top wall and four depending sidewalls and a base which contains a bottom and four upstanding sidewalls with a cover adapted to fit over the base such that the cover sidewalls are disposed exteriorly of the base sidewalls.

It has also been known to provide a box made from a single blank of material wherein the cover has a top wall and four depending sidewalls and the base has a bottom wall and three upwardly projecting sidewalls. When the box is in closed position, three of the cover depending sidewalls are disposed generally outwardly of and adjacent to the base upstanding sidewalls, and the fourth cover sidewall is integrally formed with the base so as to create a hinged cover.

In manufacturing such containers, it has been known to provide a generally flat piece of paperboard material which may be provided in individual sheet form or from a coil. A blank which is suitably configurated is severed from the remainder of the material with the blank having a window or windows in the desired location. These blanks are stacked vertically and are individually removed for transport to the window patch machine which secures an adhesively bonded piece of transparent plastic or paper to the blank in such a manner as to sealingly close each of the windows.

A problem which has been encountered in connection with the moving of individual blanks of the stack of blanks is that a window defining edge of one blank may come in edge-to-edge generally continuous contact with a window defining edge of another blank, thereby, causing the two edges to interlock and resist smooth separation.

In spite of the known means for automated manufacture of paperboard windowed boxes of this type, there is lacking an effective means for minimizing or eliminating undesired interengagement between blanks so as to resist efficient rapid transfer and processing of the blanks into a container.

SUMMARY OF THE INVENTION

The present invention has solved the above-described problem by providing a blank and resultant box provided with a plurality of uniquely configurated windows.

The windows, at the time of initial formation, are openings in the paperboard or other material out of which the box is made. The edges of the box material surrounding the windows serve to define the window opening. The windows are defined in part by a pair of window defining sides. For clarity of disclosure herein, the term "window defining side" refers to an edge of the paperboard or other box material which defines a side of a window which window is an opening which will generally have a separate material covering and closing the same. As a result, a window defining side which is concave will define a convex window side. In the preferred practice of the invention, a first series of window defining sides will be on one side of each of the windows and a second series of window defining sides will be on the other side of each window.

Assuming that in the movement of one blank over another the first series will be the leading sides and the second series will be the trailing sides, each leading side of a window will be in non-parallel relationship to the trailing sides of the windows. In each of these cases, as well as others, rather than having edge-to-edge contact, which will resist relative movement of the two blanks, the edges may contact each other at one, two or more spaced points which will facilitate relatively smooth movement of one box blank over another.

It will be appreciated that the window defining sides will have a shape which is complementary to that of the window. For example, if a window defining side is concave with a given curvature, the window per se will have a side at that location which is convex and of identical curvature. For convenience of reference herein, the shape will be described in terms of the window defining side, rather than the window per se.

Such non-parallel relationship may take the form of concave window defining sides or diverging window defining sides or other configurations.

The method of the invention involves establishing such configurations in window defining sides.

It is an object of the present invention to provide a blank for creating windowed boxes wherein the window defining portions resist undesired entanglement with another blank during the manufacturing process.

It is a further object of the present invention to provide such a construction which is aesthetically appealing and does not interfere with the manufacturing techniques employing conventional equipment or the use of the resultant box.

It is another object of the present invention to provide such a system which may be employed with a wide variety of windowed boxes.

It is a further object of the invention to provide a method of creating such a blank or the resultant box.

These and other objects of the invention will be fully understood from the following description of the invention with reference to the illustrations appended hereto.

DESCRIPTION OF THE PREFERRED EMBODIMENTS

Figure 1:
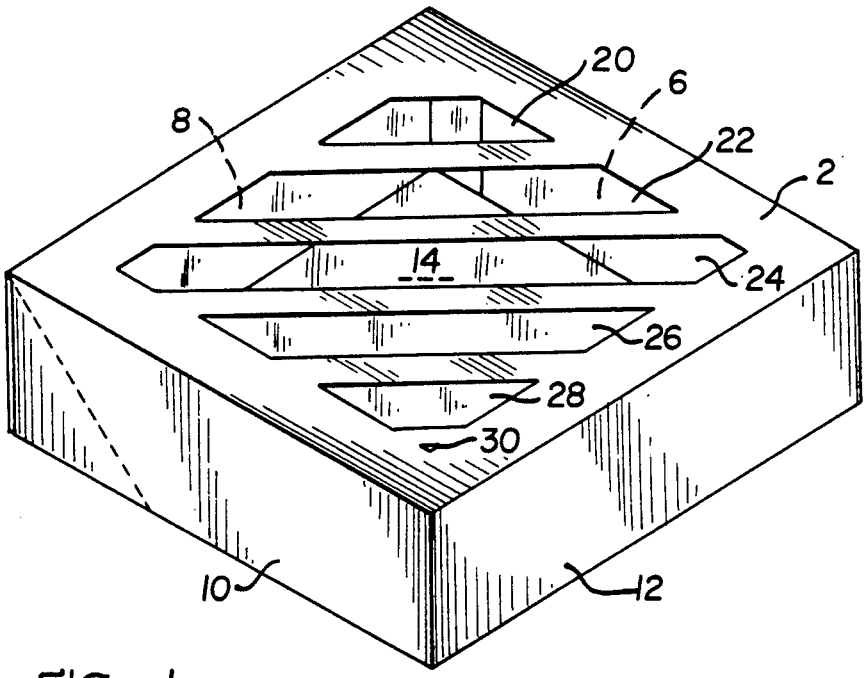
FIG. 1 is a perspective view of a form of windowed box of the general type that can be modified in accordance with the present invention.

Referring more specifically to the FIG. 1, there is shown a paperboard box which has a cover consisting of a top wall 2 and four depending sidewalls 10, 12 (and two similar walls opposite to walls 10, 12 not shown in this view). The cover is integrally hingedly attached to a bottom which has a base 14 and three upstanding sidewalls 6, 8, (and one disposed opposite to wall 6 not shown in this view). The box defines a product receiving compartment. The hinged connection is integrally formed between downwardly depending sidewall 12 and the bottom 14. Three of the four downwardly depending sidewalls are disposed exteriorly of and adjacent the upstanding sidewalls when the box is closed. The hinged top is merely rotated about the hinge to open the box. In the form illustrated, the box has a plurality of windows 20, 22, 24, 26, 28, 30 which are elongated and in relative spaced position with respect to each other and disposed solely within the top wall 2.

It will be appreciated that a product such as a cake or pie, for example, disposed within the closed box, may be visually inspected through the windows 20, 22, 24, 26, 28, 30 without opening the box. In the form shown, elongated strips of the box material separate the windows.

The box shown in FIG. 1 may be made of paperboard with a transparent plastic film adhesively secured to the underside of the window openings and closing the same. The box may come in various sizes and proportions, but in the form shown, may be 8"×8"×2" inches, for example.

Figure 2:
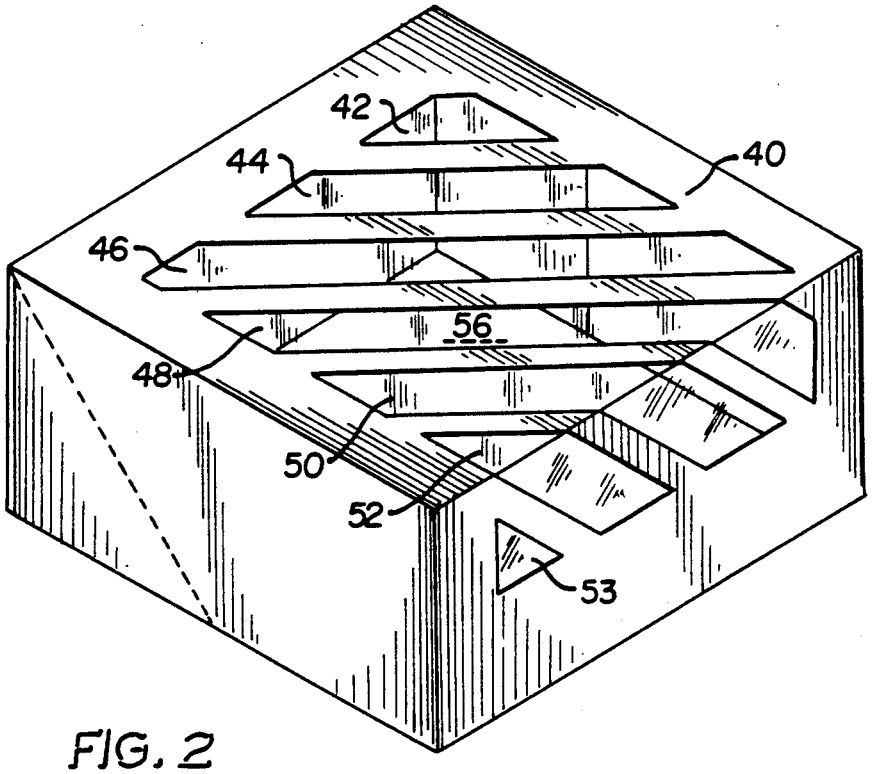
FIG. 2 is a perspective view of a modified form of box of the general type that can be modified in accordance with the present invention.

In view of the size of FIGS. 1 and 2, details of the non-parallel sides are not shown in these figures.

The box shown in FIG. 2 may be generally the same as that shown in FIG. 1 except for dimensions and window configurations. In this embodiment the box may have the dimensions of 8"×8"×4" inches, for example.

In this form, the top wall has a plurality of elongated windows 42, 44, 46, 48, 50, 52 with some of the windows 48, 50, 52 extending downward into a sidewall and which in the form shown is the fourth sidewall which is integrally secured to the bottom 56. Additional window 53 is disposed solely in the sidewall.

Figure 3:
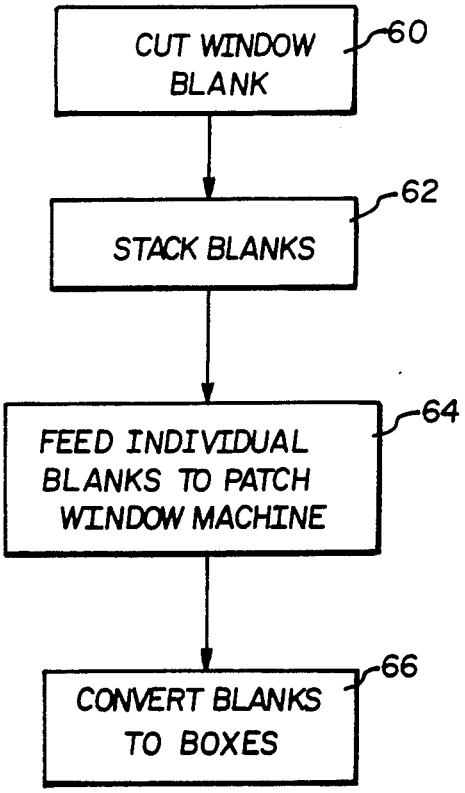
FIG. 3 is a flow diagram of the method of manufacturing windowed boxes of the present invention.

The method of making hinged boxes of the type shown in FIGS. 1 and 2 except for the unique configurations of the windows to be disclosed hereinafter will be well known to those skilled in the art. Referring to FIG. 3, in the first step 60 the windowed blank is severed from the parent paperboard stock which is in sheet or coil form. The cut blanks are then stacked at stage 62. Individual blanks are then removed from the stack of blanks and fed to the window patch machine 64. It is in this transfer stage of the operation that the prior art system created problems of inefficient transfer of an individual blank from the stack of blanks to the window patch machine as a result of continuous edge-to-edge hang-ups. The blanks are then converted 66 to boxes by conventional means which involve appropriate folding and adhesive bonding of certain portions of the blank to other portions.

Figure 4:
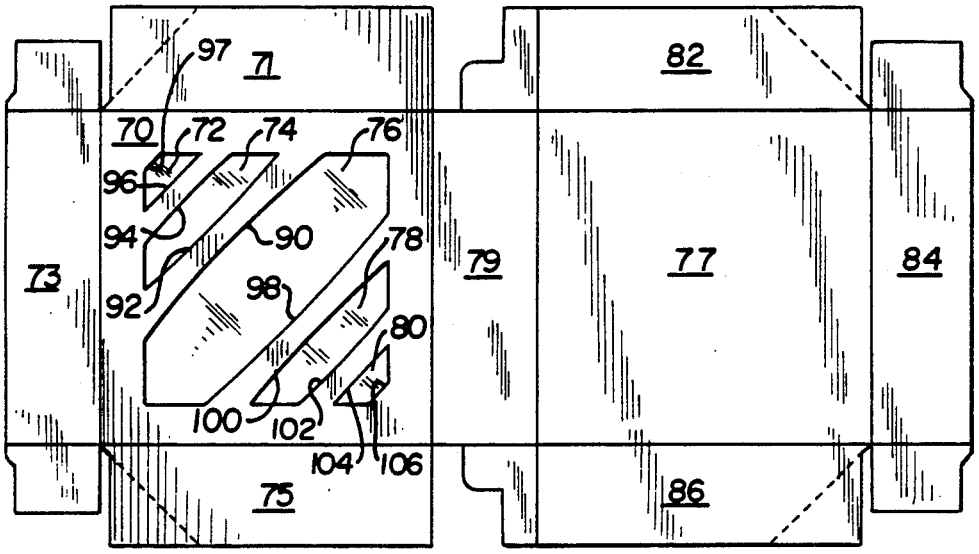
FIG. 4 is a plan view of a blank of the general type employed to make a box similar to that shown in FIG. 1, but with different window sizes.

The blank shown in FIG. 4 contains a top wall 70, four sidewall portions 71, 73, 75, 79 and a bottom 77 with three sidewall portions 82, 84, 86. When the box is formed, the sidewall portion 79, which is integrally connected to bottom 77, will provide a hinged connection and the sidewall portions 71, 73, 75 of the cover will be disposed in surface-to-surface adjacency exteriorly of sidewalls 82, 84, 86, respectively. Each of the windows 72, 74, 76, 78, 80 are defined in part by a pair of sides which are generally inwardly concave. This creates a convex window side. For example, window defining side 90 of window 76 is concave as is window defining side 92. Preferably, they have the same radii. In window 76, for example, inwardly concave window defining side 90 and inwardly concave window defining side 98 are oriented so as to have a concave shape facing toward each other and define corresponding outwardly convex window portions. The terms "inwardly" and "outwardly" in this context refer respectively to the directions generally within the plane of cover 70 laterally toward or away from the window. Window defining side 90 is in non-parallel relationship with respect to window defining side 98.

A first series of window defining sides 97, 94, 90, 100, 104 are disposed on the same side of the window and may all be of a concave configuration. A second series of window defining surfaces 96, 92, 98, 102, 106 are disposed on the same side of the window and may all be of concave configuration. If the blank of FIG. 4 were to move upwardly, window defining sides 97, 94, 90, 100, 104 would be the leading sides and window defining sides 96, 92, 98, 102, 106 would be the trailing sides. The present invention provides each leading side 97, 94, 90, 100, 104 with a configuration which will be non-parallel with respect to each of the trailing sides 96, 92, 98, 102, 106. In this manner, moving one blank over another identical blank will resist undesired edge-to-edge continuous contact of sides of windows on adjacent blanks. In this manner, contact between leading sides of one blank with trailing sides of another blank will generally be at one, two or more individual spaced points and will not cause undesired interengagement of blanks. If an identical blank were positioned over the blank shown in FIG. 4 and relative sliding movement (such as if the upper of the two blanks were to be moved directly toward the top of the drawing) there would be no continuous edge-to-edge contact between window portions. This permits ready free movement of one blank with respect to the other. When trailing window defining side 106 of the top blank sequentially meets and crosses leading window defining side 104, 100, 90, 94, 97 of the lower blank, there are only two points of contact between sides 98 and each of the other sides thereby permitting easy sliding of one blank of the other, rather than undesired interlocking.

In a preferred embodiment the radii of the inwardly concave window defining sides is about 30 to 50 inches although other dimensions may be used. It has been found that this degree of curvature will effectively resist undesired interengagement of the blanks while not undesirably altering the overall appearance of the box.

The convex curvature of this embodiment resists continuous edge-to-edge engagement of sides and substitutes limited point contact at one, two or several spaced points, which contact points move as the blanks are moved over each other. Such contact does not inhibit the desired relative movement between blanks and, as a result, facilitates manufacture of the windowed box. This is accomplished in this embodiment without materially altering the appearance of the box.

It will be appreciated that the window defining sides in the embodiments illustrated cooperate with other window defining portions to define the window. For example, windows 72, 74, 78 and 80 each have a pair of straight window defining ends connecting the window defining sides. Window 76 has a pair of generally V-shaped window defining ends connecting the window defining sides 90, 98.

It will be appreciated that other side configurations may be employed to accomplish the objectives of this invention. For example, the window defining sides of one series such as the leading sides could be curved and the window defining sides of the other series such as the trailing sides could be straight. Compound curves so configurated as to establish the desired non-parallel relationships could also be employed, for example.

Figure 5:
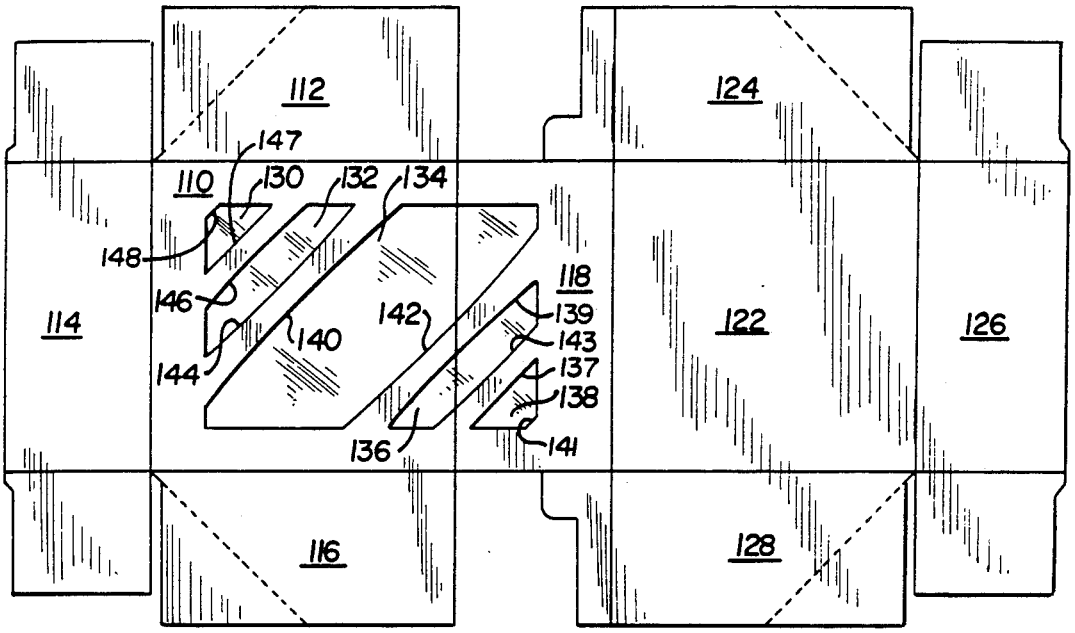
FIG. 5 is a plan view of a blank of the general type employed to make a box of the type shown in FIG. 2, but with different window sizes.

FIG. 5 shows a blank which is adapted to make a box generally similar to that illustrated in FIG. 2, except for the relative proportions of the windows being different. In this embodiment, the cover has a top 110, sidewall portions 112, 114, 116, and 118 with the base having a bottom 122 and sidewall portions 124, 126, 128. The windows 130, 132, 134, 136, 138 each have a pair of window defining sides which are concave toward the window interior such as 140 and 142 of window 134, 144 and 146 of window 132, for example. In this embodiment, however, windows 134, 136 and 138 extend into sidewall 118, thereby permitting visual exposure of the product contained within the box through both the top 110 and the side 118. As was true in the embodiment of FIG. 4, the inwardly concave window defining sides of a first or leading series 137, 139, 140, 146, 148 will each be in non-parallel relationship with respect to each of the inwardly concave window defining sides of a second or trailing series 141, 143, 142, 144, 147. In this embodiment, the sidewalls 118 may have a height of about double that of the sidewalls in the embodiment of FIG. 4.

Figure 6:
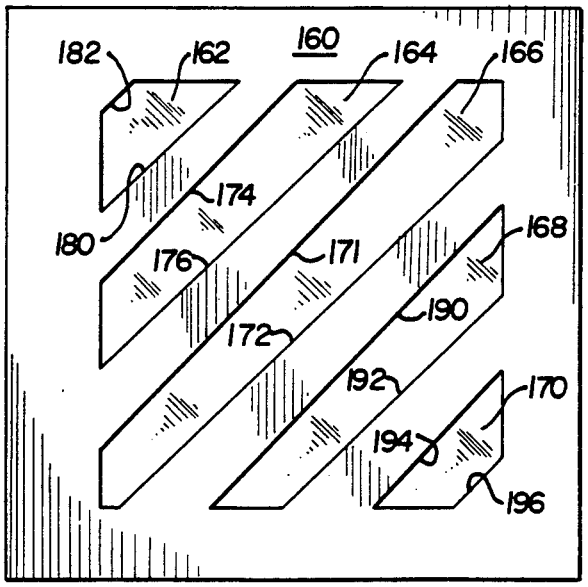
FIG. 6 is a plan of a box top having a plurality of windows which have their longitudinal center axes generally parallel and the window sides of each window diverging.

Referring to FIG. 6 there is shown an embodiment wherein the top wall 160 has a plurality of windows 162, 164, 166, 168, 170. In this embodiment, the window defining sides of each window diverge with respect to each other. More specifically, window defining sides 171, 172 of window 166 are straight lines which diverge from the lower left portion of the window 166 to the upper right. Similar diverging patterns exist between window defining sides 174, 176 of window 164, window defining sides 180, 182 of window 162, window defining sides 190, 192 of window 168, and window defining sides 194, 196 of window 170. In this embodiment, the longitudinal central axes of the windows 162, 164, 166, 168, 170 may be generally parallel to each other. In this embodiment, each leading window defining side 182, 174, 171, 190, 194 will be non-parallel with respect to each trailing window defining side 180, 176, 172, 192, 196.

The method of the present invention includes providing the material out of which the box will be made in generally sheet or coil form converting the material into a box blank having a plurality of windows and defining the windows at least in part with a pair of spaced window defining sides. A first series of window defining sides will each be non-parallel with respect to each of a second series of window defining sides.

It will be appreciated, therefore, the present invention has provided an aesthetically pleasing effective and economical means for resisting undesired jamming of equipment handling a stack of box blanks caused by blank interengagement.

While a specific reference has been made to windows of particular shape in a paperboard box having a plastic transparent cover on the windows, it will be appreciated that the invention is applicable to other types of windows and other types of container materials.

While for simplicity of disclosure a windowed box having a cover hinged to a base has been disclosed, other types of windowed boxes may be employed. For example, a two piece box having a fully removable top may employ the window designs for the present invention. Also, a one piece box can be provided.

While the window defining "sides" as illustrated herein, are longer than the window ends, the invention is not so limited and embraces windows wherein adjacent sides of adjacent windows are equal to or less than the length of the other window edges. Also, the ends may have other than a single straight shape. Examples of such alternatives are shown in window 24 (FIG. 1), window 46 (FIG. 2), window 76 (FIG. 4), window 134 (FIG. 5) and window 166 (FIG. 6).

Whereas particular embodiments of the invention have been described herein for purposes of illustration, it will be evident to those skilled in the art that numerous variations of the details may be made without departing from the invention as defined in the appended claims.

We claim:

1. A box comprising, a cover and a base cooperating to define a product receiving compartment, said cover having a plurality of windows formed therein, at least a majority of said windows being oriented in relatively spaced relationship with respect to each other, each said window being defined at least in part by a pair of window defining sides, each of a first series of window defining sides disposed generally on one side of said windows being non-parallel with respect to each of a second series of said window defining sides disposed generally on the other side of said windows, at least some of said window defining sides being non-parallel with respect to the adjacent window defining sides of adjacent windows, said window defining sides being generally straight, one window defining side of each said window diverging with respect to the other said window defining side of said window, and said windows having longitudinal axes which are generally parallel to each other.

2. The box of claim 1, including said cover having a top wall and a plurality of depending sidewalls, and said base having a bottom and a plurality of upstanding sidewalls.

3. The box of claim 2, including said cover having four said depending sidewalls, and said base having three said upstanding sidewalls.

4. The box of claim 3, including said cover being connected to said base by an integral hinge connection disposed at the base of one of said depending sidewalls.

5. The box of claim 4, including said windows being elongated, and at least portions of said windows extending into said depending sidewall that is connected to said base.

6. The box of claim 2, wherein said box being a two piece box.

7. The box of claim 2, including said box being composed of paperboard.

8. The box of claim 7, including said windows being covered by a transparent material.

9. A box comprising, a cover and a base cooperating to define a product receiving compartment, said cover having a plurality of windows formed therein, at least a majority of said windows being oriented in relatively spaced relationship with respect to each other, each said window being defined at least in part by a pair of window defining sides, each of a first series of window defining sides disposed generally on one side of said windows being non-parallel with respect to each of a second series of said window defining sides disposed generally on the other side of said windows, said window defining sides being inwardly generally concave, and said generally concave window defining sides having a radius of about 30 to 50 inches.

10. The box of claim 9, including said cover having a top wall and a plurality of side walls, and said base having a bottom and a plurality of upstanding sidewalls.

11. The box of claim 10, including said cover having four said depending sidewalls, and said base having three said upstanding sidewalls.

12. The box of claim 11, including said cover being connected to said base by an integral hinge connection disposed at the base of one of said depending sidewalls.

13. The box of claim 12, including said windows being elongated, and at least a portion of said windows extending into said depending sidewall that is connected to said base.

14. The box of claim 10, wherein said box being a two piece box.

15. The box of claim 10, including said box being composed of paperboard.

16. The box of claim 15, including said windows being covered by a transparent material.

17. A box comprising, a cover and a base cooperating to define a product receiving compartment, said cover having a plurality of windows formed therein, at least a majority of said windows being oriented in relatively spaced relationship with respect to each other, each said window being defined at least in part by a pair of window defining sides, each of first series of window defining sides disposed generally on one side of said windows being non-parallel with respect to each of a second series of said window defining sides disposed generally on the other side of said windows, said first series of window defining sides being leading sides, said second series of window defining sides being trailing sides, said first series of window defining sides being inwardly generally concave, and said second series of window defining sides being generally straight.

18. The box of claim 17, including said cover having a top wall and a plurality of side walls, and said base having a bottom and a plurality of upstanding sidewalls.

19. The box of claim 18, including said cover having four said depending sidewalls, and said base having three said upstanding sidewalls.

20. The box of claim 19, including said cover being connected to said base by an integral hinge connection disposed at the base of one of said depending sidewalls.

21. The box of claim 20, including said windows being elongated, and at least a portion of said windows extending into said depending sidewall that is connected to said base.

22. The box of claim 18, wherein said box being a two piece box.

23. The box of claim 18, including said box being composed of paperboard.

24. The box of claim 23, including said windows being covered by a transparent material.

25. A paperboard box blank, comprising said blank having a generally flat configuration and having a plurality of windows disposed in generally spaced relationship with respect to each other, each said window being defined at least in part by a pair of spaced window defining sides, each of a first series of said window defining sides being non-parallel with respect to each of a second series of said window defining sides, whereby said blank will be characterized by the property of being slidable over another said blank which is generally identically oriented thereto without having a window defining side of one window engage the window defining side of a window of the other said blank in continuous edge-to-edge contact so as to resist desired smooth movement of one said blank over the other said blank, at least some of said window defining sides being non-parallel with respect to the adjacent window defining sides of adjacent windows, said window defining sides being generally straight, one window defining side of each said window diverging with respect to the other said window defining side of said window, said windows having longitudinal axes which are generally parallel to each other.

26. The blank of claim 25, including said window defining sides being so configurated that contact between edges of a pair of said blanks will result in engagement of the edges at a maximum of several individual relatively spaced points.

27. The blank of claim 25, including said blank being made of paperboard.

28. A paperboard box blank, comprising said blank having a generally flat configuration and having a plurality of windows disposed in generally spaced relationship with respect to each other, each said window being defined at least in part by a pair of spaced window defining sides, each of a first series of said window defining sides being non-parallel with respect to each of a second series of said window defining sides, whereby said blank will be characterized by the property of being slidable over another said blank which is generally identically oriented thereto without having a window defining side of one window engage a window defining side of a window of the other said blank and continuous edge-to-edge contact so as to resist undesired smooth movement of one said blank over the other said blank, said first series of window defining sides being leading sides, said second series of window defining sides being trailing sides, said first series of window defining sides being inwardly generally concave, and said second series of window defining sides being generally straight.

29. The blank of claim 25, including said windows being elongated.

30. A paperboard box blank, comprising said blank having a generally flat configuration and having a plurality of windows disposed in generally spaced relationship with respect to each other, each said window being defined at least in part by a pair of spaced window defining sides, each of a first series of said window defining sides being non-parallel with respect to each of a second series of said window defining sides, whereby said blank will be characterized by the property of being slidable over another said blank which is generally identically oriented thereto without having a window defining side of one window engage the window defining side of a window of the other said blank and continuous edge-to-edge contact so as to resist undesired smooth movement of one said blank over the other said blank, said window defining sides being so configured that contact between edges of a pair of said blanks will result in engagement of the edges at a maximum of several individual relatively spaced points, said window defining sides being inwardly generally concave, and said generally concave window sides having a radius of about 30 to 50 inches.

31. A method of manufacturing a box comprising, providing generally sheet-like material out of which said box will be made, converting said material into a box blank having a plurality of windows, establishing said windows each with a pair of spaced window defining sides, establishing a first series of window defining sides comprising one window defining side of each said pair of window defining sides with each of said first series of sides being non-parallel with respect to each of a second series of window defining sides comprising the other window defining side of each pair of sides, establishing said window defining sides such that at least some of said window defining sides are non-parallel with respect to the adjacent window defining sides of adjacent windows, establishing said window defining sides with generally straight sides, establishing a window defining side of each said window in a path which diverges from the other window defining side of said window, and converting said blank into a box.

32. The method of claim 31, including establishing said first series as leading sides and said second series as trailing sides.

33. The method of claim 31, including establishing said box with a cover integrally connected to a base.

34. The method of claim 33, including establishing said cover with a top wall and a plurality of depending sidewalls, and creating at least a portion of said windows in said top wall.

35. A method of manufacturing a box comprising, providing generally sheet-like material out of which said box will be made, converting said material into a box blank having a plurality of windows, establishing said windows each with a pair of spaced window defining sides, establishing a first series of window defining sides comprising one window defining side of each said pair of window defining sides with each of said first series of sides being non-parallel with respect to each of a second series of window defining sides comprising the other window defining side of each pair of sides, establishing said non-parallel window defining sides with an inwardly concave configuration, establishing said window defining sides with a radius of about 30 to 50 inches, and converting said blank into a box.

36. A method of manufacturing a box comprising, providing generally sheet-like material out of which said box will be made, converting said material into a box blank having a plurality of windows, establishing said windows each with a pair of spaced window defining sides, establishing a first series of window defining sides comprising one window defining side of each said pair of window defining sides with each of said first series of sides being non-parallel with respect to each of a second series of window defining sides comprising the other window defining side of each pair of sides, converting said blank into a box, establishing said non-parallel sides with a compound curvature, establishing said first series of window defining sides with an inwardly generally concave shape, and establishing said second series of window defining sides with a generally straight shape.

37. The method of claim 36, including establishing at least a portion of said windows in a said depending sidewall.

* * * * *

UNITED STATES PATENT AND TRADEMARK OFFICE

CERTIFICATE OF CORRECTION

PATENT NO. : 5,060,852

DATED : October 29, 1991

INVENTOR(S) : Alan Beckerman, et al

It is certified that error appears in the above-identified patent and that said Letters Patent is hereby corrected as shown below:

Claim 30, column 9, line 50, --defining-- should be inserted after "window".

Signed and Sealed this

Fifth Day of October, 1993

*Attest:*

*Attesting Officer*

BRUCE LEHMAN

*Commissioner of Patents and Trademarks*